United States Patent [19]

Uetsuhara

[11] Patent Number: 4,859,975

[45] Date of Patent: Aug. 22, 1989

[54] ELECTROMAGNETIC ACTUATOR

[75] Inventor: Tokio Uetsuhara, Urawa, Japan

[73] Assignees: Mitsubishi Mining & Cement Co., Ltd., Tokyo; Iwasaki Electronics Co., Ltd., Kyoto, both of Japan

[21] Appl. No.: 139,251

[22] PCT Filed: Dec. 26, 1986

[86] PCT No.: PCT/JP86/00663

§ 371 Date: Dec. 2, 1987

§ 102(e) Date: Dec. 2, 1987

[87] PCT Pub. No.: WO88/05207

PCT Pub. Date: Jul. 14, 1988

[51] Int. Cl.[4] ..... H01F 7/08

[52] U.S. Cl. ..... 335/230; 335/234

[58] Field of Search ..... 335/78, 79, 80, 81, 335/229, 230, 234, 84, 85

[56] References Cited

U.S. PATENT DOCUMENTS

| | | | |
|---|---|---|---|
| 4,142,166 | 2/1979 | Arnoux | 335/230 X |
| 4,451,808 | 5/1984 | Koehler | 335/229 |
| 4,604,599 | 8/1986 | Koehler | 335/230 |

FOREIGN PATENT DOCUMENTS

| | | | |
|---|---|---|---|
| 57-76804 | 5/1982 | Japan | 335/230 |
| 57-76805 | 5/1982 | Japan | 335/230 |
| 59-148306 | 8/1984 | Japan | 335/230 |
| 59-182510 | 10/1984 | Japan | 335/230 |
| 218709 | 12/1984 | Japan | 335/230 |

*Primary Examiner*—George Harris

*Attorney, Agent, or Firm*—Bierman and Muserlian

[57] ABSTRACT

The present invention relates to an improvement in an electromagnetic actuator which is composed of a yoke, a stationary core fixed to the yoke, a movable core capable of reciprocally moving with respect to the stationary core, a coil wound around the movable core for applying the first magnetic flux thereto when the coil is energized, and a permanent magnet fixed to the yoke or the movable core so as to apply the second magnetic flux which dividingly flows to the first magnetic flux in parallel thereto. This improved electromagnetic actuator is characterized that it satisfies the condition (a);

$$\text{(a) } 0.5 > R_1/R_0 > 0$$

wherein, $R_1$ represents the magnetic reluctance of the magnetic pass of one divided magnetic flux generated by the permanent magnet, including the magnetic reluctance of the gap $d_1$ between one pole face of the movable core and one pole face of the yoke;

$R_2$ represents the maganetic reluctance of the magnetic pass of the other divided magnetic flux generated by the permanent magnet, including the magnetic reluctance of the gap $d_2$ between the other pole face of the movable core and one pole face fo the stationary core; and $$R_2 = R_1 + R_2$$

So the acutator can provide a high sensitivity and a great actuating force with using a low current and can be applied to a electromagnetic valve and the like.

4 Claims, 9 Drawing Sheets

$\phi p / \phi o = 0.5$

| Rp / Ro | NO |
|---|---|
| 4.0 | 1 |
| 2.0 | 2 |
| 1.0 | 3 |
| 0.5 | 4 |

$\phi p / \phi o = 1.0$

| Rp / Ro | NO |
|---|---|
| 4.0 | 1 |
| 2.0 | 2 |
| 1.0 | 3 |
| 0.5 | 4 |

$\phi p / \phi o = 2.0$

| Rp / Ro | NO |
|---|---|
| 4.0 | 1 |
| 2.0 | 2 |
| 1.0 | 3 |
| 0.5 | 4 |

$\phi p / \phi o = 4.0$

| Rp / Ro | NO |
|---|---|
| 4.0 | 1 |
| 2.0 | 2 |
| 1.0 | 3 |
| 0.5 | 4 |

$\phi p / \phi o = 0.5$

| Rp / Ro | NO |
|---|---|
| 4.0 | 1 |
| 2.0 | 2 |
| 1.0 | 3 |
| 0.5 | 4 |

$\phi p / \phi o = 1.0$

| Rp / Ro | NO |
|---|---|
| 4.0 | 1 |
| 2.0 | 2 |
| 1.0 | 3 |
| 0.5 | 4 |

$\phi p / \phi o = 2.0$

| Rp / Ro | NO |
|---|---|
| 4.0 | 1 |
| 2.0 | 2 |
| 1.0 | 3 |
| 0.5 | 4 |

$\phi p / \phi o = 4.0$

| Rp/Ro | NO |
|---|---|
| 4 | 1 |
| 2 | 2 |
| 1 | 3 |
| 0.5 | 4 |
| 1/3 | 5 |

ELECTROMAGNETIC ACTUATOR

TECHNICAL FIELD

The present invention relates to an electromagnetic actuator which is used for specific devices such as electromagnetic valves, electromagnetic pumps, electromagnetic locking devices, electromagnet relays, electromagnetic clutches, and so on which can electromagnetically control a holding operation of a mechanical stable state and a shifting operation from such mechanical stable state.

BACKGROUND TECHNICS OF THE INVENTION

Generally, commonly used electromagnetic valves and the like have contained the electromagnetic actuator as shown in FIG. 10. Such type electromagnetic actuator comprises a stationary core 1 fixed on a yoke 2, movable core 3 movably arranged with respect to the stationary core 1 so as to reciprocally move in the direction represented by the arrow 11, and coil 7 wound around the movable core 3 to generate the first magnetic flux 8 when the coil 7 is energized.

However, this type electromagnetic actuator is relatively poor in its sensitivity and thus can not generate required attractive force at a low current. The inventor of the present invention has already proposed improved electromagnetic actuators which can generate great moving force in spite of low current. This type electromagnetic actuators have been shown in PCT/JP84/00084, PCT/JP85/00313, PCT/JP85/00314, and PCT/JP85/00536.

This type of electromagnetic actuator further comprise a permanent magnet 5 in addition to the conventional device as shown in FIG. 10. In detail, as shown in FIG. 1 to FIG. 4, the permanent magnet 5 is secured to the yoke 2 or the movable core 3 so as to generate the second magnetic flux 9 which dividingly flows in parallel to the first magnetic flux 8 generated by the coil 7.

In the previously invented devices shown in FIG. 1, FIG. 2 and FIGS. 3(*a*), (*b*), the movable core 3 is reciprocally moved in the direction represented by the arrow 11 with respect to the stationary core 1.

In the previously invented device shown in FIG. 4(*a*) and FIG. 4(*b*), the movable core 3 is secured to a shaft 13*a* and can be rotatably moved in the direction represented by the arrow 11 with respect to the stationary core 1 through a journal 13*b*.

However, the above described devices shown in FIG. 1 to FIG. 4, previously proposed by the inventor of the present invention, can not always provide characteristics of a high sensitivity since it depends on the combination of values such as magnetomotive forces caused by the coil 7 and the permanent magnet 5 and magnetic reluctances of the permanent magnet 5 and in the gap between the movable core 3 and the stationary core 1 or the movable core 3 and the yoke 2.

DESCRIPTION OF THE INVENTION

Thererfore, in order to overcome the above mentioned problems, it is an object of the present invention to easily provide an improved electromagnetic actuator which can provide a high sensitivity and a great actuating force with using a low current.

The present invention is based on the following knowledges according to various experiments and theoretical analysis.

First of all, arithmetic operation on the magnetic circuits of conventional devices, previously proposed by the inventor of the present invention, shown in FIG. 5 and FIG. 6 will be conducted.

In these drawings, a stationary core 1 is installed in a yoke 2 with fixing to the inside of the yoke 2. A movable core 3 is so arranged as to be capable of reciprocating in the direction represented by the arrow 11 with respect to the stationary core 1. A first gap $d_1$ is defined between a pole face 2*a* of the yoke 2 and a pole face 3*a* of the movable core 3. A second gap $d_2$ is also defined between a pole face 1*a* of the stationary core 1 and a pole face 3*b* of the movable core 3.

A permanent magnet 5 is fixed on the inner wall of the yoke 2. In detail, its S-pole face is fixed on the inner wall and its N-pole face faces to the movable core 3 through a gap g.

Assuming that the first magnetic flux 8 generated when a coil 7 is energized by the current as shown in the drawings and the second magnetic fluxes 9*a* and 9*b*, dividingly flowed in parallel to the first magnetic flux 8, generated by the permanent magnet 5 are wholly passed through the gaps $d_1$ and $d_2$, the equivalent magnetic circuits of the devices shown in FIG. 5 and FIG. 6 are represented by the circuit diagram in FIG. 7.

Although the electromotive force $F_1$ of the equivalent magnetic circuits of the devices shown in FIG. 5 and FIG. 6 is located in the position marked by the dotted line in FIG. 7 and FIG. 9, this arithmetic operation will be performed on the assumption that the position of $F_1$ corresponds to that of $F_o$ as a matter of convenience.

The parameters used in this arithmetic operation are as follows.

- $F_o$; Magnetomotive force generated when the coil 7 is energized.
- $F_p$; Magnetomotive force generated by the permanent magnet 5.
- S; Sectional area of the gaps $d_1$ and $d_2$.
- $S_p$; Sectional area of the gap g.
- $L_p$; Length of magnetizing direction caused by the permanent magnet 5.
- $\mu_o$; Permeability of the gaps $d_1$ and $d_2$.
- $\mu_r$; Reversible permeability of the permanent magnet 5.
- $R_1$; Magnetic reluctance of the magnetic pass of one devided magnetic flux 9*a* generated by the permanent magnet 5, including magnetic reluctance of the gap $d_1=(d_1/\mu_o)S$.
- $R_2$; Magnetic reluctance of the magnetic pass of the other divided magnetic flux 9*b* generated by the permanent magnet 5, including the magnetic reluctance of the gap $d_2=(d_2/\mu_o)S$.
- $R_p$; Magnetic reluctance of the permanent magnet 5$=(L_p/\mu_r)S_p$.

In these parameters, the magnetic reluctance $(g/\mu_o)S_p$ of the gap g is contained in the magnetic reluctance $R_p$.

Now, in order to independently obtain the first magnetic flux 8 generated when the cil 7 is energized, and the second magnetic fluxes 9*a* and 9*b* generated by permanent magnet 5, the circuit shown in FIG. 7 is applied with the principle of superposition.

First of all, the second magnetic fluxes 9*a* and 9*b* are obtained in the following manner.

If the second magnetic fluxes *9a* and *9b* passing through the gaps $d_1$ and $d_2$ in the equivalent circuit shown in FIG. 8 are respectively represented by $\phi_1$ and $\phi_2$, the following quadratic equations will be established.

$$F_p=R_p(\phi_1+\phi_2)+R_1\phi_1 \quad (1)$$

$$R_1\phi_1=R_2\phi_2 \quad (2)$$

According to the equations (1) and (2), $$\phi_1=(R_2F_p)/\{R_p(R_1+R_2)+R_1+R_2\} \quad (3)$$

$$\phi_2=(R_1F_p)/\{R_p(R_1+R_2)+R_1R_2\} \quad (4)$$

Nextly, the first magnetic flux 8 generated by the coil 7 is obtained as follows.

If the magnetic flux passing through the permanent magnet 5 is represented by $\phi_4$ ad the magnetic flux passing the gap $d_2$ is represented by $\phi_3$ in the equivalent circuit shown in FIG. 9, the following equation (5) will be established.

$$F_o=(R_1+R_2)\phi_3+R_1\phi_4 \quad (5)$$

$$R_p\phi_4=R_2\phi_3 \quad (6)$$

These equations are rearranged to obtain the values of $\phi_3$ and $\phi_4$.

$$\phi_3=(R_pF_o)/\{(R_1+R_2)R_p+(R_1R_2)\} \quad (7)$$

$$\phi_4=(R_2F_o)/\{(R_1+R_2)R_p+(R_1R_2)\} \quad (8)$$

At the next step, the arithmetic operation will be conducted on the electromagnetic force P applied to the movable core 3.

The electromagnetic force P applied to the movable core 3 of the electromagnetic actuator shown in FIG. 5 is generated in only the gap $d_1$, and the electromagnetic force P is generated in both the gaps $d_1$ and $d_2$ of the bistable type electromagnetic actuator shown in FIG. 6. The value of the electromagnetic force P is proportion to the square of the magnetic flux passing through the gaps $d_1$ and $d_2$. This relation is expressed by the following equation.

$$P=\phi^2/(2\mu_oS) \quad (9)$$

wherein,

P; the electromagnetic force applied to the movable core 3.

$\phi$; the magnetic flux passing through the gaps $d_1$ and $d_2$.

Accordingly the above equations (4), (7) and (9), the force represented by $P_s$ applied to the movable core 3 of the monostable type electromagnetic actuator shown in FIG. 5 is obtained by the following equation;

$$P_s=\{1/(2\mu_oS)\}[(R_1F_p+R_pP_o)/\{R_p(R_1+R_2)+R_1R_2\}]^2 \quad (10)$$

Further, according to the above equations (3), (4), (7), (8) and (9), the force represented by $P_d$ applied to the movable core 3 of the bistable type electromagnetic actuator shown in FIG. 6 is obtained by the following equation wherein the magnetic fluxes passing through the gaps $d_1$ and $d_2$ respectively represented by $\phi d_1$ and $\phi d_2$;

$$P_d = \{1/(2\mu_oS)\}(\phi d_2^2 - \phi d_1^2) = [(R_1F_p + R_pF_o)^2 - \{R_2(F_p - F_o) - R_pF_o\}^2]/[(2\mu_oS\{R_p(R_1 + R_2) + R_1R_2\}^2] \quad (11)$$

wherein, the magnetic flux $\phi d_1$ passing through the gap $d_1$ is expressed by the equation;

$$\phi d_1=\phi_1-\phi_4- \quad 3,$$

and the magnetic flux $\phi d_2$ passing through the gap $d_2$ is expressed by the equation;

$$\phi d_2=\phi_2+\phi_3.$$

The direction of the forces P, $P_s$, and $P_d$ making the movable core 3 move rightwards in the drawings represents the positive direction.

Another conventional device shown in FIG. 10 has the same values of the sectional area of the movable core 3, the length of the gaps $d_1$ and $d_2$, and the magnetomotive force generated by the coil 7 when it is energized as the conventional devices shown in FIG. 5 and FIG. 6, previously proposed by the inventor of the present invention. The arithmetic operation wil be also executed on these conventional devices in order to compare the forces applied to the movable cores 3 in the respective devices.

The magnetic reluctance $R_o$, the magnetic flux $\phi_o$, and the force $P_o$ applied to the movable core 3 of the conventional device shown in FIG. 10 are respectively represented by the following equations.

$$R_o = R_1 + R_2 \quad (12)$$

$$\phi_o = F_o/R_o \quad (13)$$

$$P_o = \phi_o^2/(2\mu_oS) = F_o^2/(2\mu_o \cdot S \cdot R_o^2) \quad (14)$$

According to the equations (10), (11), and (14), the ratio of the forces applied to the respective movable cores 3 when the coils 7 of the respective devices are energized in the manner shown in the drawings is represented by the following equations.

$$P_s/P_o = [(R_1F_p + R_pF_o)/\{R_p(R_1 + R_2) + R_1R_2\}]^2 \times (R_o/F_o)^2 = \{1 + (R_1F_p/R_pP_o)\}^2/\{1 + (R_1R_2/R_pR_o)\}^2 \quad (15)$$

$$P_d/P_o = [(R_1F_p + R_pF_o)^2 - \{R_2(F_p - F_o) - R_pF_o\}^2 \times (R_o/F_o)^2]/(R_pR_o + R_1R_2)^2 = [\{1 + (R_1F_p + R_pF_o)\}^2 - \{1 + R_2/R_p) - (R_2F_p)/R_pF_o)\}^2]/\{1 + (R_1R_2/R_pR_o)\}^2 \quad (16)$$

In order to form the normalization grasp with respect to the equations (15) and (16), the parameters from them should be selected.

The values of the magnetic reluctances $R_1$, $R_2$ and $R_p$ are divided, by the value of the magnetic reluctance $R_o$ to form non-dimensional formulae as follows.

$$R_1/R_o = d_1/d \quad (17)$$

$$R_2/R_o = 1 - (d_1/d) \quad (18)$$

$$R_p/R_o = (\mu_oSL_p)/(\mu_rS_pd) \quad (19)$$

Wherein, "d" is represented by the equation $d_1+d_2$.

In order to obtain the parameter representing the size of the permanent magnet 5, both sides of the equation $\phi_p = F_p/R_p$ are respectively divided by the basic magneic flux $\phi_o = F_o/R_o$ as follows.

$$\phi_p/\phi_o = (R_o F_p)/(R_p F_o) \quad (20)$$

Then the equations (17), (18) and (20) are substituted into the equations (15) and (16), and rearranged as follows. That is, these rearranged equations can represent the value of the force applied to the movable core 3 of the electromagnetic actuator in the normalization graph which employs two parameters of $\phi_p/\phi_o$ and $R_p/F_o$ and a variable $d_1/d(\approx R_1/R_o)$.

$$P_s/P_o = \{1 + (d_1\,\phi_p/d\,\phi_o)\}^2/[1 + (R_o + R_p)\{(d_1/d) - (d_1^2/d^2)\}]^2 \quad (21)$$

$$P_d/P_o = [\{1 + (d_1\,\phi_p/d\,\phi_o)\}^2 - \{1 + (1 - d_1/d))((R_o/R_p) - (\phi_p/\phi_o))\}^2]/[\{1 + (R_o/R_p)((d_1/d) - (d_1^2/d^2))\}^2] \quad (22)$$

Wherein, the magnetic reluctance $R_p$ of the permanent magnet 5 is in inverse proportion to its reversible permeability $\mu_r$ and in proportion to the length of magnetizing direction caused by the permanent magnet 5.

Here the value of the reversible permeability $\mu_r$ is approximate to the permeability $\mu_o$ in a vacuum. Accordingly, if the sectional area $S_p$ of the gap "g" is equivalent to S, the equation (19) is rearranged and thus the following equation will be established.

$$R_p/R_o \approx L_p/d$$

Although in an ordinary way the valve of $L_p$ is greater than that of "d", we will discuss on the value of $R_p/R_o$ within the range of $\frac{1}{3}$ to $\frac{1}{4}$.

If the intensity of magnetization of the permanent magnet 5 is represented by $J_p$ and the magnetic flux density B caused by the coil 7 in the energized state, the following equation will be established.

$$\Phi_p/\Phi_o = (J_p S_p)/(B \cdot S)$$

The value of $J_p$ depends on the material for the magnet such as 0.4(T) for a ferrite magnet, 0.8(T) for a casting magnet, 1.0(T) for a rare earth magnet and so on. Thus the value of $\Phi_p/\Phi_o$ is variable. Although, we will discuss on the range from 0.5 to 4.

As mentioned above, the electromagnetic force applied to the movable core 3 of the monostable type electromagnetic actuator shown in FIG. 5 is represented by the equation (21) with ignoring leakage flux. As shown in the graphs in FIG. 11(*a*), FIG. 11(*b*), FIG. 11(*c*), FIG. 11(*d*), the value of $P_s/P_o$ with respect to various values of $\Phi_p/\Phi_o$ can be calculated with taking the values of $R_p/R_o$ as the parameter and the values of $R_1/R_o$ as the variable.

Also the electrmagnetic force applied to the movable core 3 of the bistable type electromagnetic actuator shown in FIG. 6 can be calculated by equation (22). The resulted values are shown in the graphs in FIG. 12(*a*), FIG. 12(*c*) and FIG. 12(*d*).

According to the resulted values from the graphs in FIG. 11(*a*), FIG. 11(*b*), FIGS. 11(*c*) and 11(*d*) and FIG. 12(*a*), FIG. 12(*b*), FIG. 12(*c*) and FIG. 12(*d*), and the results from various tests on the trial device of the present invention, the following condition is always required to be valid for the condition that the value of $P_s/P_o$ or $P_d/P_o$ is greater than 1; that is, the electromagnetic force applied to the movable core 3 of the electromagnetic actuator shown in FIG. 5 or FIG. 6 previously proposed by the inventor is greater than that of conventional electroagnetic actuator shown in FIG. 10.

(a) $0.5 > R_1/R_o > 0$

Further, if the following condition (b) is satisified in addition to the condition (a), a higher sensitive property will be obtained.

(b) $\phi_p/\phi_o > 0.5$

Also if the following condition (c) is satisfied in addition to the conditions (a) and (b), a furthermore high sensitive property will be obtained.

(c) $R_p/R_o > 0.25$

The present invention has been achieved in accordance with the above mentioned knowledge. In detail, the present invention relates to an improvement in electromagnetic actuator which is composed of a yoke, a stationary core fixed to the yoke, a movable core capable of reciprocally moving with respect to the stationary core, a coil wound around the movable core for applying the first magnetic flux thereto when the coil is energized, and a permanent magnet fixed to the yoke or the movable core so as to apply the second magnetic flux which dividingly flows to the first magnetic flux in parallel thereto. Therefore, it is an object of the present invention to provide an improved electromagnetic actuator which can satisfy the condition (a).

(a) $0.5 > R_1/R_o > 0$

Wherein, $R_1$ represents the magnetic reluctance of the magnetic pass of one divided magnetic flux generated by the permanent magnet, including the magnetic reluctance of the gap $d_1$ between one pole face of the movable core and one pole of the yoke;

$R_2$ represents the magnetic reluctance of the magnetic pass of the other divided magnetic flux generated by the permanent magnet, including the magnetic reluctance of the gap $d_2$ between the other pole face of the movable core and one pole face of the stationary core; and $$R_o = R_1 + R_2$$

As explained above, the device according to the present invention can provide superior effects that a great actuating force can be always generated by consuming an extremely low current since the values of the magnetic reluctance and magnetotive force and so on in its magnetic circuit can be restricted within a predetermined range.

THE BEST MODE FOR EMBODYING THE PRESENT INVENTION

Hereinafter, the present invention will be explained in detail according to the embodiments in conjunction with the accompanying drawings.

Figure 1:
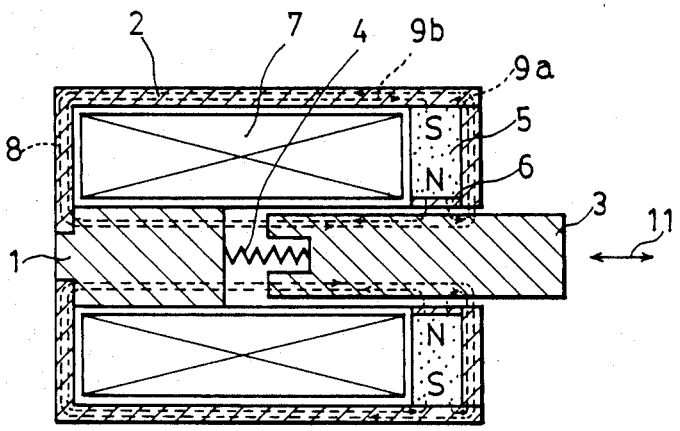
FIG. 1 is a schematic illustration for explaining the conventional device previously proposed by the inventor of the present invention and the first embodiment of the present invention.
Figure 2:
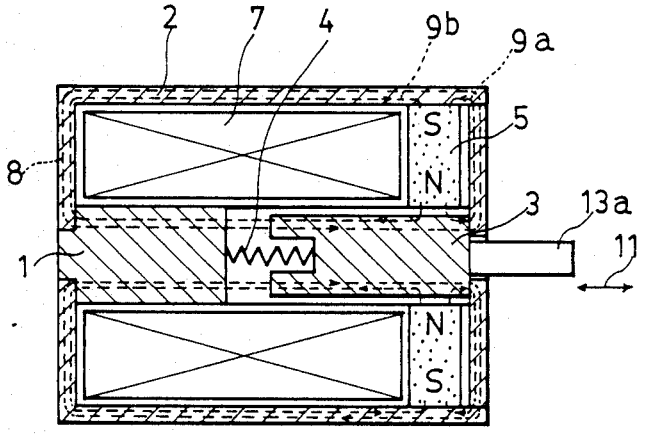
FIG. 2 is a schematic illustration for explaining the conventional device previously proposed by the inventor of the present invention and the second embodiment of the present invention.
Figure 3:
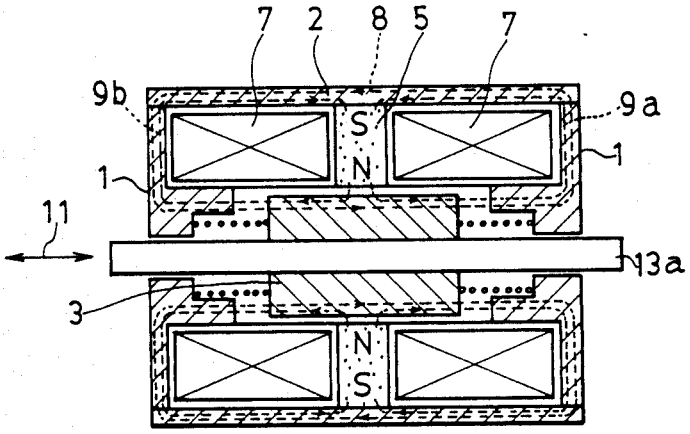
FIG. 3 is a schematic illustration for explaining the conventional device previously proposed by the inventor of the present invention and the third embodiment of the present invention.
Figure 4:
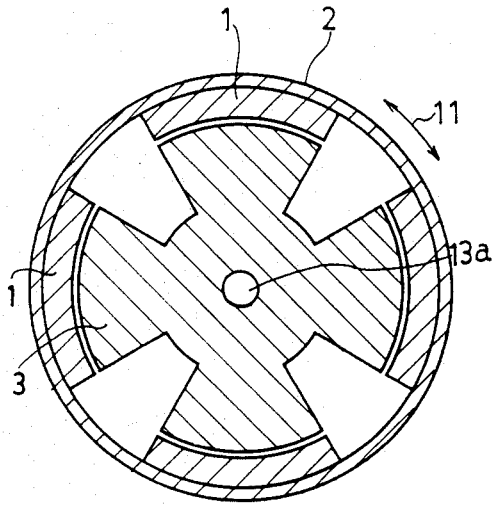
FIG. 4(*a*) and FIG. 4(*b*) are schematic views for explaining the conventional device previously proposed by the inventor of the present invention and the fourth embodiment of the present invention, wherein FIG. 4(*a*) is a sectional view taken along the line A—A in FIG. 4(*b*)
Figure 4:
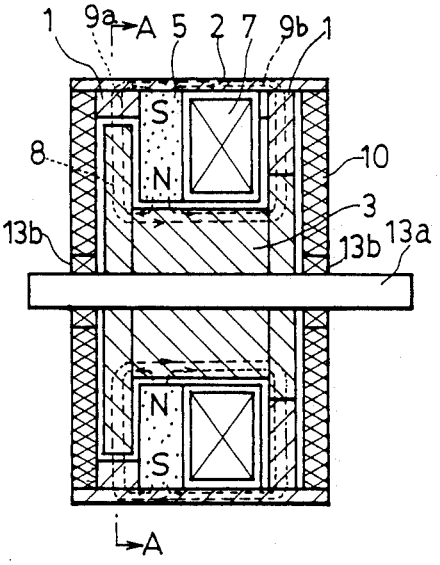
Figure 5:
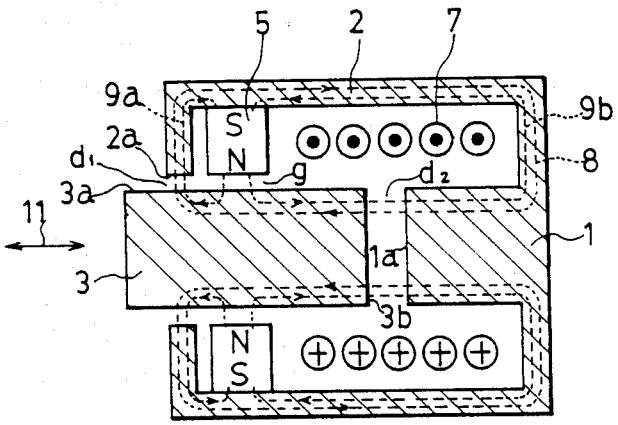
FIG. 5 and FIG. 6 are schematic views for explaining the conventional devices previously proposed by the inventor of the present invention.
Figure 6:
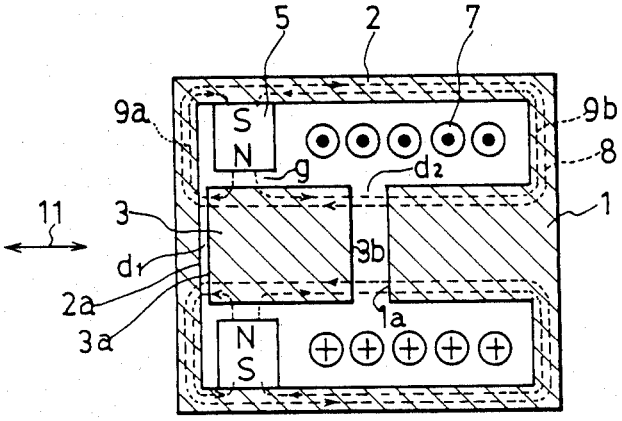
Figure 7:
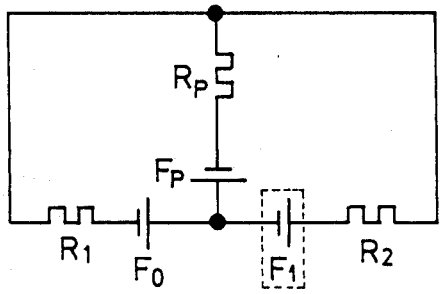
FIG. 7, FIG. 8 and FIG. 9 are circuit diagrams showing equivalent magnetic circuits.
Figure 8:
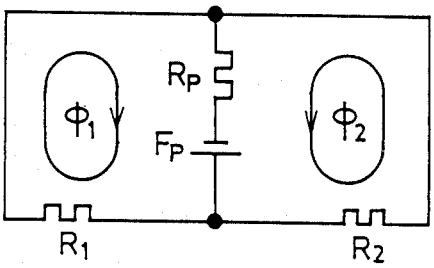
Figure 9:
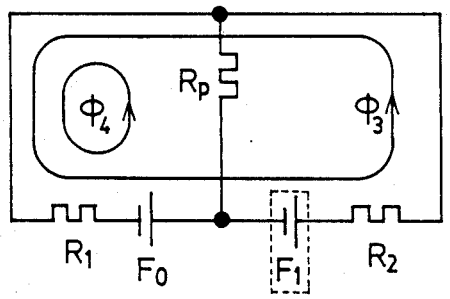
Figure 10:
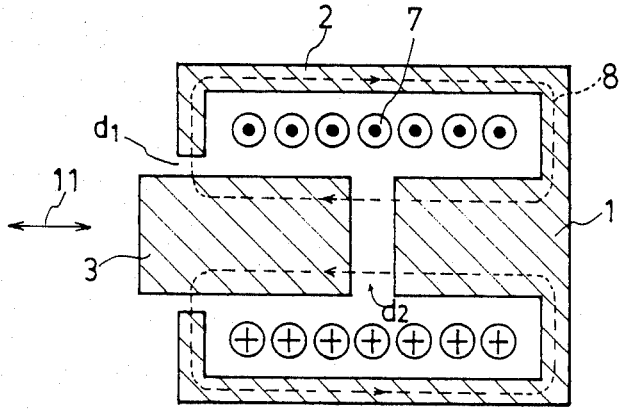
FIG. 10 is a schematic view for explaining the conventional device.
Figure 11A:
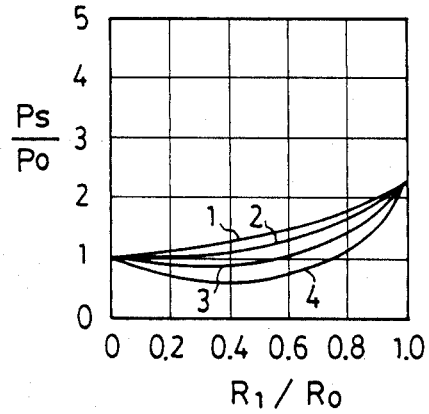
FIG. 11(*a*), FIG. 11(*b*), FIG. 11(*c*) and FIG. 11(*d*) are the tables and graphs for explaining electromagnetic force generated by the conventional device shown in FIG. 5.
Figure 11B:
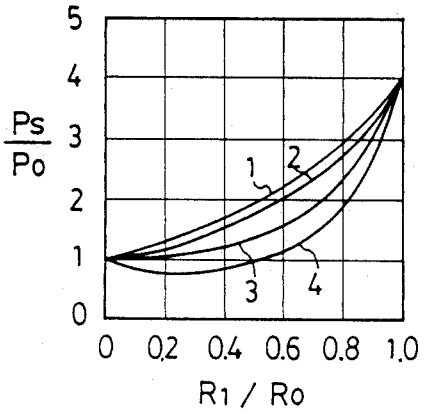
Figure 11:
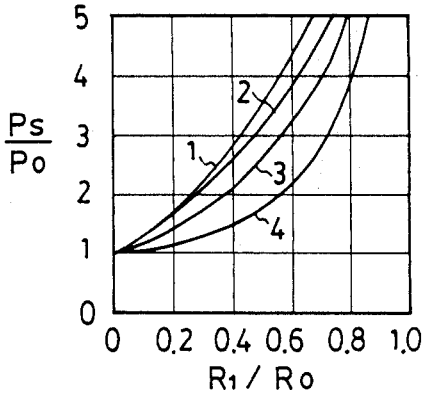
Figure 11:
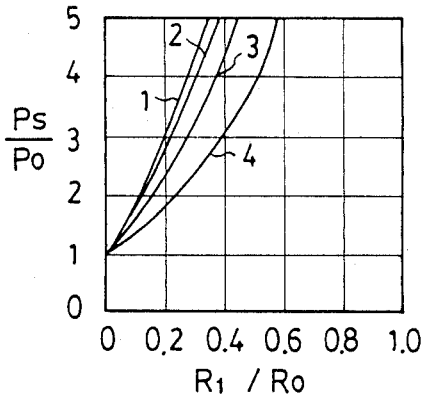
Figure 12A:
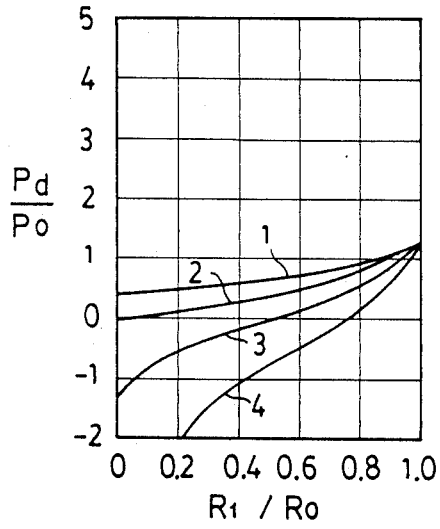
FIG. 12(*a*), FIG. 12(*b*), FIG. 12(*c*) and FIG. 12(*d*) are tables and graphs for explaining electromagnetic force generated by the conventional shown in FIG. 6.
Figure 12:
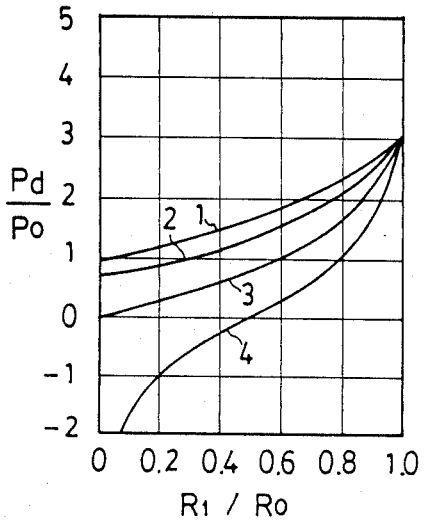
Figure 12:
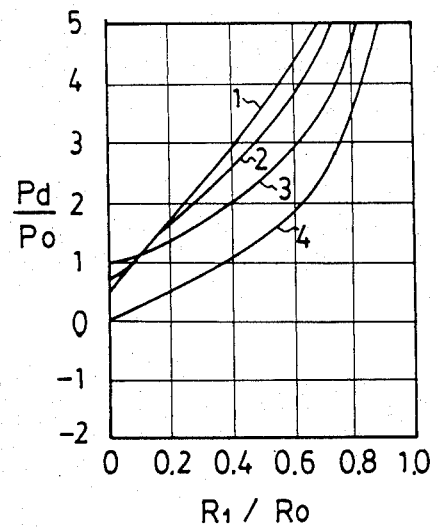
Figure 12:
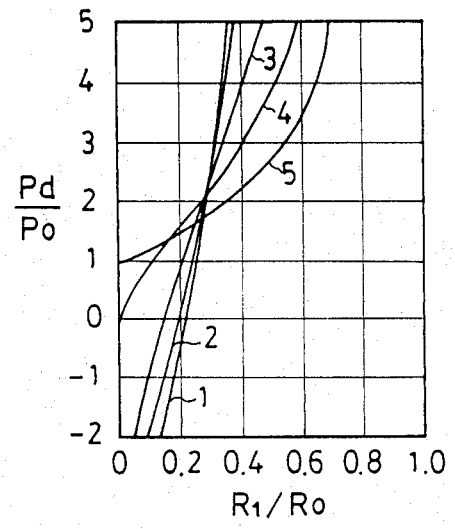
Figure 13A:
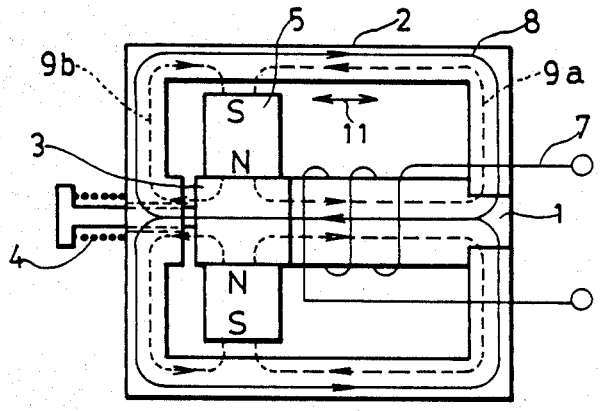
FIGS. 13*a* and 13*b* are schematic views for explaining the invention in which a permanent magnet is fixed to the movabe core.
Figure 13B:
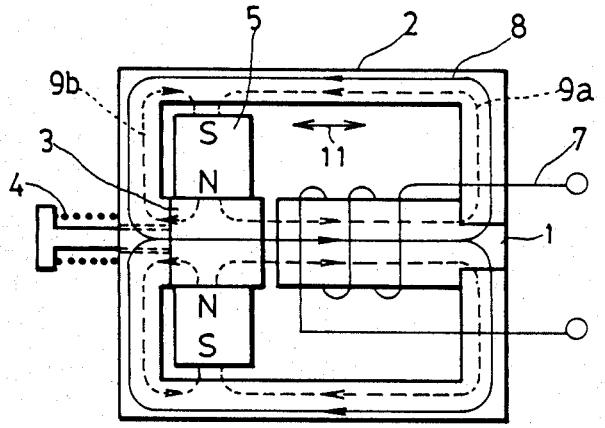

The embodiments according to the present invention have the substantially same structure as the conventional devices shown in FIG. 1 to FIG. 4 except for the following points.

The embodiments are so designed as to satisfy the condition defined by the eqation (a):

$$0.5 > R_1/R_o > 0$$

wherein, $R_1$ represents the magnetic reluctance of the magnetic pass of one divided magnetic flux 9*a* generated by the permanent magnet 5, including the magnetic reluctance of the gap $d_1$ between one pole face of the movable core and one pole face of the yoke;

$R_2$ representes the magnetic reluctance of the magnetic pass of the other divided magnetic flux 9*b* generated by the permanent magnet 5, including the magnetic reluctance of the gap $d_2$ between the other pole face of the movable core and one pole face of the stationary core; and $$R_o R_1 + R_2$$

Further, the following condition (b) is satisfied in addition to the condition (a), a higher sensitive property will be obtained.

$$\text{(b) } \phi_p/\phi_o > 0.5$$

wherein $R_p$ represents the magnetic reluctance of the premanent magnet;

$F_o$ represents the magnetomotive force caused by energizing the coil;

and $F_p$ represents the magnetomotive force caused by the permanent magnet.

wherein, $\phi_o$ represents the magnetic flux caused by energizing the coi; and $\phi_p$ equals to $R_oF_p/R_pF_o$.

Also if the folowing condition (c) is satisfied in addition to the conditions (a) and (b), a furthermore high sensitive property will be obtained.

In order to satisfy these conditions formulae the current for energizing the coil 7 of the winding number thereof may be suitably adjusted; the length between N and S poles of the permanent magnet 5 may be adjusted; the perment 5 per se such as material, figure, or the like may be selected; the magnetic pole faces of the stationary core, the yoke and the movable core may be meltingly covered or plated with a non-magnetic material layer; and/or the distace of the gaps $d_1$ and $d_2$ may bed adjusted by cutting work.

AVAILABILITY IN INDUSTRIAL FIELD

The present invention can be applied to the device which electromagnetically controls a holding operation of a mechanical stable state and a shifting operation from the mechanical stable state; for example, electromagnetic valve, electromagnetic pump, electromagnetic locking device, electromagnetic relay, electromagnetic clutch, and the like.

I claim:

1. An electromagnetic actuator which is composed of a yoke, a stationary core fixed to the yoke, a movable core capable of reciprocally moving with respect to the stationary core, a coil wound around the movable core for applying the first magnetic flux thereto when the coil is energized, and a permanent magnet fixed to the yoke so as to apply the second magnetic flux which dividingly flows to the first magnetic flux in parallel thereto; wherein the improvement is characterized that this electromagnetic actuator satisfies the condition (a);

$$\text{(a) } 0.5 > R_1/R_o > 0$$

wherein, $R_1$ represents the magnetic reluctance of the magnetic pass of one divided magnetic flux generated by the permanent magnet, including the magnetic reluctance of the gap $d_1$ between one pole face of the movable core and one pole face of the yoke;

$R_2$ represents the magnetic reluctance of the magnetic pass of the other divided magnetic flux generated by the permanent magnet, including the magnetic reluctance of the gap $d_2$ between the other pole face of the movable core and one pole face of the stationary core; and $$R_o = R_1 + R_2.$$

2. The electromagnetic actuator as set forth in claim 1 further satisfying the following condition (b);

$$\text{(b) } \phi_p/\phi_o > 0.5$$

wherein, $\phi_o$ represents the magnetic flux caused when the coil is energized; and $\phi_p$ equals to $R_oF_p/R_pF_o$ wherein, $R_p$ represents the magnetic reluctance of the permanent magnet; $F_o$ represents the magnetomotive force caused when the coils energize; and $F_p$ represents the magnetomotive force caused by the permanent magnet.

3. The electromagnetic actuator as set forth in claim 2 further satisfying the following condition (c):

(c) $R_p/R_o > 0.25$.

4. An electromagnetic actuator which is composed of a yoke, a stationary coke fixed to the yoke, a movable core capable of reciprocally moving with respect to the stationary core, a coil wound around the movable core for applying the first magnetic flux thereto when the coil is energized, and a permanent magnet flux which dividingly flows to the first magnetic flux in parallel thereto; wherein the improvement is characterized; that this electromagnetic actuator satisfies the condition (a);

(a) $0.5 > R_1 R_o > 0$ wherein, $R_1$ represents the magnetic reluctance of the magnetic pass of one divided magnetic flux generated by the permanent magnet, including the magnetic reluctance of the gap $d_1$ between one pole face of the movable core and one pole face of the yoke;

$R_2$ represents the magnetic reluctance of the magnetic pass of the other divided magnetic flux generated by the permanent magnet, including the magnetic reluctance of the gap $d_2$ between the other pole face of the movable core and one pole face of the stationary core; and $R_o = R_1 + R_2$.

* * * * *

UNITED STATES PATENT AND TRADEMARK OFFICE

CERTIFICATE OF CORRECTION

PATENT NO. : 4,859,975

DATED : Aug. 22, 1989

INVENTOR(S) : Tokio Uetsuhara

It is certified that error appears in the above-identified patent and that said Letters Patent is hereby corrected as shown below:

Col. 2, line 63 "cil" should be --coil--.

Col. 5, line 12, "($\approx R_1R_o$)" to read --($\doteq R_1R_o$)-- and line 31, "$R_p/R_o \approx L_p/d$" to read --$R_p/R_o \doteq L_p/d$--.

Col. 9, line 15, after "magnet" insert --fixed to the movable core so as to apply the second magnetic--.

Signed and Sealed this

Eighth Day of May, 1990

*Attest:*

HARRY F. MANBECK, JR.

*Attesting Officer*

*Commissioner of Patents and Trademarks*

US004859975B1

REEXAMINATION CERTIFICATE (2281st)

United States Patent [19]

Uetsuhara

[11] B1 4,859,975

[45] Certificate Issued * Apr. 26, 1994

[54] ELECTROMAGNETIC ACTUATOR

[75] Inventor: Tokio Uetsuhara, Urawa, Japan

[73] Assignees: Mitsubishi Mining & Cement, Tokyo; Iwasaki Electronics Co. Ltd., Kyoto, both of Japan

Reexamination Request:
No. 90/002,505, Nov. 12, 1991

Reexamination Certificate for:

| | |
|---|---|
| Patent No.: | **4,859,975** |
| Issued: | **Aug. 22, 1989** |
| Appl. No.: | **139,251** |
| Filed: | **Dec. 2, 1987** |

[ * ] Notice: The portion of the term of this patent subsequent to Nov. 10, 2004 has been disclaimed.

Certificate of Correction issued May 8, 1990.

[22] PCT Filed: Dec. 26, 1986

[86] PCT No.: PCT/JP86/00663

§ 371 Date: Dec. 2, 1987

§ 102(e) Date: Dec. 2, 1987

[87] PCT Pub. No.: WO88/05207

PCT Pub. Date: Jul. 14, 1988

[51] Int. Cl.[5] ..... H01F 7/13; H01F 7/08

[52] U.S. Cl. ..... 335/230; 335/234

[58] Field of Search ..... 335/229, 230, 231, 232, 335/233, 234, 235

[56] References Cited

U.S. PATENT DOCUMENTS

| | | | |
|---|---|---|---|
| 4,419,643 | 12/1983 | Ojima et al. | 335/234 |
| 4,706,055 | 11/1987 | Uetsuhara | 335/229 |
| 4,797,645 | 1/1989 | Uetsuhara | 335/220 |

FOREIGN PATENT DOCUMENTS

| | | |
|---|---|---|
| 31331 | 7/1980 | Japan . |
| 186312 | 11/1982 | Japan . |
| 11414 | 1/1985 | Japan . |
| 261111 | 12/1985 | Japan . |
| 04044 | 9/1985 | PCT Int'l Appl. . |

*Primary Examiner*—Leo P. Picard

[57] ABSTRACT

The present invention relates to an improvement in an electromagnetic actuator which is composed of a yoke, a stationary core fixed to the yoke, a movable core capable of reciprocally moving with respect to the stationary core, a coil wound around the movable core for applying the first magnetic flux thereto when the coil is energized, and a permanent magnet fixed to the yoke or the movable core so as to apply the second magnetic flux which dividingly flows to the first magnetic flux in parallel thereto. This improved electromagnetic actuator is characterized that it satisfies the condition (a);

$$(a)\ 0.5 > R_1/R_0 > 0$$

wherein, $R_1$ represents the magnetic reluctance of the magnetic pass of one divided magnetic flux generated by the permanent magnet, including the magnetic reluctance of the gap $d_1$ between one pole face of the movable core and one pole face of the yoke;

$R_2$ represents the magnetic reluctance of the magnetic pass of the other divided magnetic flux generated by the permanent magnet, including the magnetic reluctance of the gap $d_2$ between the other pole face of the movable core and one pole face of the stationary core; and $$R_2 = R_1 + R_2$$

So the actuator can provide a high sensitivity and a great actuating force with using a low current and can be applied to a electromagnetic valve and the like.

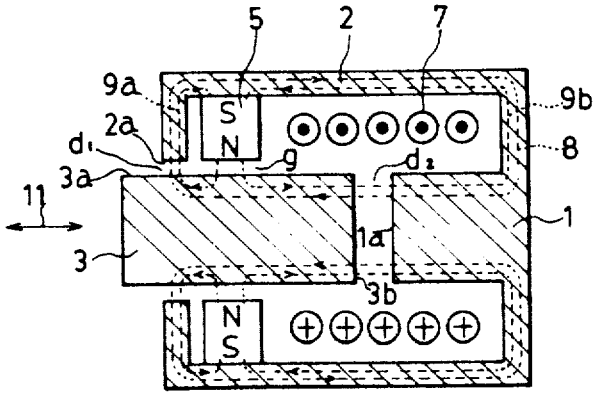

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 7, lines 39-59:

The embodiments are so designed as to satisfy the condition defined by the eqation (a):

$$0.5 > R_1/R_0 > 0$$

wherein, $R_1$ represents the magnetic reluctance of the magnetic pass of one divided magnetic flux 9a generated by the permanent magnet 5, including the magnetic reluctance of the gap $d_1$ between one pole face of the movable core and one pole face of the yoke;

$R_2$ represents the magnetic reluctance of the magnetic pass of the other divided magnetic flux 9b generated by the permanent magnet 5 including the magnetic reluctance of the gap $d_2$ between the other pole face of the movable core and one pole face of the stationary core; and $$[R_0 R_1 + R_2]\ R_0 = R_1 + R_2$$

Column 8, lines 1-8:

$F_O$ represents the magnetomotive force caused by energizing the coil;

and $F_p$ represents the magnetomotive force caused by the permanent magnet.

wherein, $\phi_o$ represents the magentic flux caused by energizing the coi; and $[\phi_p]$ $\phi_p/O_o$ equals to $R_o F_p / R_p F_o$.

Column 8, lines 12-21:

In order to satisfy these conditions formulae the current for energizing the coil 7 of the winding number thereof may be suitably adjusted; the length between N and S poles of the permanent magnet 5 may be adjusted; the [perment] *permanent magnet* 5 per se such as material, figure, or the like may be selected; the magnetic pole faces of the stationary core, the yoke and the movable core may be meltingly covered or plated with a non-magnetic material layer; and/or the distance of the gaps $d_1$ and $d_2$ may [bed] *be* adjusted by cutting work.

AS A RESULT OF REEXAMINATION, IT HAS BEEN DETERMINED THAT:

Claims 2-4 are cancelled.

Claim 1 is determined to be patentable as amended.

New claims 5-7 are added and determined to be patentable.

1. An electromagnetic actuator which is composed of a yoke, a stationary core fixed to the yoke, a movable core *which is confronted consistently with a circumferential gap $d_1$ to the yoke and with a moving stroke gap $d_2$ to the stationary core and is* capable of reciprocally moving, with respect to the stationary core, a coil wound around the movable core for applying the first magnetic flux thereto when the coil is energized, *and* a permanent magnet fixed to the yoke so as to apply [the] *a* second magnetic flux which dividingly flows to the first magnetic flux in parallel thereto, *and a spring which keeps the movable core at a stable position by cancelling electromagnetic force between the stationary core and the movable core induced by the permanent magnet when the coil is not energized*; wherein the improvement is characterized that this electromagnetic actuator satisfies the [condition] *conditions* (a) *and* (*b*) *within a magnetically non-saturated zone;*

$$\text{(a)}\ 0.5 > R_1/R_0 > 0$$

$$(b)\ \phi_p/\phi_o > 0.5$$

wherein, $R_1$ represents the magnetic reluctance of the magnetic [pass] *path* of one divided magnetic flux generated by the permanent magnet, including the magnetic reluctance of the gap $d_1$ between [one pole face] *the circumferential surface* of the movable core and one pole face of the yoke; $R_2$ represents the magnetic reluctance of the magnetic [pass] *path* of the other divided magnetic flux generated by the permanent magnet, including the magnetic reluctance of the gap $d_2$ between the [other pole] *moving end* face of the movable core and one pole face of the stationary core; and $$R_0 = R_1 + R_2;$$

*$\phi_o$ represents the magnetic flux caused when the coil is energized; and*

$\phi_p/\phi_o$ equals to $R_o F_p / R_p F_o$; *wherein $R_p$ represents the magnetic reluctance of the permanent magnet; $F_o$ represents the magnetomotive force caused when the coil is energized; and $F_p$ represents the magnetomotive force caused by the permanent magnet.*

*5. An electromagnetic actuator comprising a yoke, a stationary core fixed to the yoke, a movable core which is confronted consistently with a circumferential gap $d_1$ to the yoke and with a moving stroke gap $d_2$ to the stationary core and is capable of reciprocally moving with respect to the stationary core, a coil wound around the movable core for applying a first magnetic flux thereto when the coil is energized, a permanent magnet fixed to the yoke to apply a second magnetic flux which dividingly flows to the first magnetic flux in parallel thereto, and a spring which keeps the movable core at a stable position by cancelling electromagnetic force between the stationary core and the movable core induced by the permanent magnet when the coil is not energized; wherein the improvement is characterized in that the electromagnetic actuator comprises at least one means selected from the group consisting of means for adjusting current and/or number of winding turns of the coil, means for adjusting distance between N and S poles of the permanent magnet, means for selecting material and figure of the permanent magnet, and means for adjusting*

*the distance of the gaps $d_1$ and $d_2$ by cutting, in order to satisfy the conditions (a), (b) and (c) within a magnetically non-saturated zone:*

(a) $0.5 > R_1/R_0 > 0$ (b) $\phi_p/\phi_o > 0.5$ (c) $R_p/R_o > 0.25$

*wherein,*

$R_1$ *represents the magnetic reluctance of the magnetic path of one divided magnetic flux generated by the permanent magnet, including the magnetic reluctance of the gap $d_1$ between the circumferential surface of the movable core and one pole face of the yoke;*

$R_2$ *represents the magnetic reluctance of the magnetic path of the other divided magnetic flux generated by the permanent magnet, including the magnetic reluctance of the gap $d_2$ between the moving end face of the movable core and one pole face of the stationary core;*

$R_0 = R_1 + R_2$;

$\phi_o$ *represents the magnetic flux when the coil is energized and*

$\phi_p/\phi_o$ *equals* $R_oF_p/R_pF_o$;

$R_p$ *represents the magnetic reluctance of the permanent magnet;*

$F_o$ *represents the magnetomotive force caused by the coil is energized; and*

$F_p$ *represents the magnetomotive force caused by the permanent magnet.*

*6. An electromagnetic actuator comprising a yoke, a stationary core fixed to the yoke, a movable core which is confronted consistently with a circumferential gap $d_1$ to the yoke and with a moving stroke gap $d_2$ to the stationary core and is capable of reciprocally moving with respect to the stationary core, a coil wound around the movable core for applying a first magnetic flux thereto when the coil is energized, a permanent magnet fixed to the yoke so as to apply a second magnetic flux which dividingly flows to the first magnetic flux in parallel thereto, and a spring which keeps the movable core at a stable position by cancelling electromagnetic force between the stationary core and the movable core induced by the permanent magnet when the coil is not energized; wherein the improvement is characterized in that the electromagnetic actuator comprises, to satisfy conditions (a), (b), and (c) within a magnetically non-saturated zone;*

(a) $0.5 > R_1/R_o > 0$ (b) $\phi_p/\phi_o > 0.5$ (c) $R_p/R_o > 0.25$

*wherein,*

$R_1$ *represents the magnetic reluctance of the magnetic path of one divided magnetic flux generated by the permanent magnet, including the magnetic reluctance of the gap $d_1$ between the circumferential surface of the movable core and one pole face of the yoke;*

$R_2$ *represents the magnetic reluctance of the magnetic path of the other divided magnetic flux generated by the permanent magnet, including the magnetic reluctance of the gap $d_2$ between the moving end face of the movable core and one pole face of the stationary core;*

$R_o = R_1 + R_2$;

$\phi_o$ *represents the magnetic flux caused when the coil is energized;*

$\phi_p/\phi_o$ *equals* $R_oF_p/F_pF_o$;

$R_p$ *represents the magnetic reluctance of the permanent magnet;*

$F_o$ *represents the magnetomotive force caused when the coil is energized; and*

$F_p$ *represents the magnetomotive force caused by the permanent magnet.*

*7. An electromagnetic actuator comprising a yoke, a stationary core fixed to the yoke, a movable core which is confronted consistently with a circumferential gap $d_1$ to the yoke and with a moving stroke gap $d_2$ to the stationary core and is capable of reciprocally moving with respect to the stationary core, a coil wound around the movable core for applying a first magnetic flux thereto when the coil is energized, a permanent magnet fixed to the yoke so as to apply a second magnetic flux which dividingly flows to the first magnetic flux in parallel thereto, and a spring which keeps the movable core at a stable position by cancelling electromagnetic force between the stationary core and the movable core induced by the permanent magnet when the coil is not energized; wherein the improvement is characterized in that the electromagnetic actuator comprising adjusted distances of said gap $d_1$ between one pole face of the movable core and one pole face of the yoke and said gap $d_2$ between the other face of the movable core and one pole face of the stationary core to satisfy the conditions (a), (b), and (c) within a magnetically non-saturated zone;*

(a) $0.5 > R_1/R_o > 0$ (b) $\phi_p/\phi_o > 0.5$ (c) $R_p/R_o > 0.25$

*wherein,*

$R_1$ *represents the magnetic reluctance of the magnetic path of one divided magnetic flux generated by the permanent magnet, including the magnetic reluctance of the gap $d_1$ between the circumferential surface of the movable core and one pole face of the yoke;*

$R_2$ *represents the magnetic reluctance of the magnetic path of the other divided magnetic flux generated by the permanent magnet, including the magnetic reluctance of the gap $d_2$ between the moving end face of the movable core and one pole face of the stationary core;*

$R_o = R_1 + R_2$;

$\phi_o$ *represents the magnetic flux caused when the coil is energized;*

$\phi_p/\phi_o$ *equals* $R_oF_p/R_pF_o$;

$R_p$ *represents the magnetic reluctance of the permanent magnet;*

$F_o$ *represents the magnetomotive force caused by the coil is energized; and*

$F_p$ *represents the magnetomotive force caused by the permanent magnet.*

* * * * *